US007407168B2

(12) United States Patent
Lee

(10) Patent No.: US 7,407,168 B2
(45) Date of Patent: Aug. 5, 2008

(54) SIZE ADJUSTING MECHANISM FOR INLINE ROLLER SKATE

(76) Inventor: Hung-Pin Lee, 5F., No. 6, Alley 26, Lane 841, Bei-An Rd., Taipei (TW) 104

( * ) Notice: Subject to any disclaimer, the term of this patent is extended or adjusted under 35 U.S.C. 154(b) by 26 days.

(21) Appl. No.: 11/673,526

(22) Filed: Feb. 9, 2007

(65) Prior Publication Data

US 2008/0143066 A1 Jun. 19, 2008

(30) Foreign Application Priority Data

Dec. 19, 2006 (TW) ..... 95222345 U

(51) Int. Cl.
*A63C 1/26* (2006.01)

(52) U.S. Cl. ..... 280/11.26; 280/11.27

(58) Field of Classification Search ..... 280/11.26, 280/11.27, 11.221, 11.16, 11.19
See application file for complete search history.

(56) References Cited

U.S. PATENT DOCUMENTS 6,574,888 B2 * 6/2003 Miller et al. ..... 36/97
6,916,027 B2 * 7/2005 Chen ..... 280/11.26
6,918,602 B2 * 7/2005 Lu ..... 280/11.26
6,983,942 B2 * 1/2006 Chen ..... 280/11.26
7,175,186 B2 * 2/2007 Lin ..... 280/11.26
7,246,803 B2 * 7/2007 Sauter et al. ..... 280/11.26
2006/0201033 A1 * 9/2006 Tang ..... 36/97
2006/0220332 A1 * 10/2006 Zeng ..... 280/11.26

* cited by examiner

*Primary Examiner*—Christopher Ellis
*Assistant Examiner*—John D Walters
(74) *Attorney, Agent, or Firm*—Pai Patent and Trademark Law Firm; Chao-Chang David Pai

(57) ABSTRACT

A size adjusting mechanism for inline roller skate includes a boot seat, and a toe cap longitudinally movably mounted above the boot seat. An engaging element is controlled by a control element to transversely slide in the boot seat. The control element has a curved inner end contacting with an end of the engaging element, and turnable about an eccentric pivot shaft. A first and a second adjusting element are respectively provided on the engaging element and below the toe cap to normally engage with each other and thereby keep the toe cap immovable on the boot seat. When the control element is turned for the engaging element to engage with a point on the curved inner end farther from the pivot shaft, the first adjusting element is disengaged from the second adjusting element, allowing the toe cap to move relative to the boot seat.

12 Claims, 7 Drawing Sheets

SIZE ADJUSTING MECHANISM FOR INLINE ROLLER SKATE

RELATED APPLICATIONS

The present application is based on, and claims priority from, Taiwan Application Serial Number 95222345, filed Dec. 19, 2006, the disclosure of which is hereby incorporated by reference herein in its entirety.

FIELD OF THE INVENTION

The present invention relates to an adjusting mechanism, and more particularly, to a size adjusting mechanism for an inline roller skate.

BACKGROUND OF THE INVENTION

Taiwan Patent Publication No. 378553 discloses an adjusting structure for changing the size of an inline roller skate. The adjusting structure includes a wedge-shaped block downward extended from a toe cap of a boot provided on the inline roller skate. A plurality of spaced adjusting bores is transversely extended through the wedge-shaped block. A seat of the skate is provided at one side corresponding to the wedge-shaped block with a locating hole. When it is desired to adjust the size of the inline roller skate, simply move the toe cap to a desired position with one of the adjusting bores on the wedge-shaped block aligned with the locating hole on the seat of the skate, and then use a bolt to lock the toe cap to the skate seat. In this manner, many different sizes are available from the same one inline roller skate, making the inline roller skate very suitable for developing children, and giving the inline roller skate very good applicability.

However, to perform the adjustment of the inline roller skate via the above-described adjusting structure, it is necessary to repeatedly loosen and then tighten the bolt. This is of course time-consuming and troublesome for a user to do so. Therefore, it is desirable to develop an improved mechanism for adjusting an inline roller skate to different sizes.

SUMMARY OF THE INVENTION

A primary object of the present invention is to provide a size adjusting mechanism for inline roller skate, so that the inline roller skate may be easily, conveniently, and quickly adjusted via the size adjusting mechanism to different sizes according to a user's actual need and therefore provides good applicability.

The inline roller skate also includes a plurality of wheels and a boot mounted to a lower and an upper side, respectively, of the size adjusting mechanism.

The size adjusting mechanism for inline roller skate according to a preferred embodiment of the present invention includes a boot seat, a toe cap, a control unit, and an adjusting unit.

The boot seat is provided with a mounting recess, which is inwardly extended from a lateral side of the boot seat.

The toe cap is longitudinally movably connected to a top front of the boot seat.

The control unit includes an engaging element, a control element, and a pivot shaft. The engaging element is transversely movably mounted in the boot seat at a predetermined position.

The control element has an inner part received in the mounting recess and an outer part exposed to an outer side of the boot seat; and the inner part of the control element received in the mounting recess has a curved peripheral surface, which is in contact with the engaging element and has a first and a second retaining notch spaced thereon.

The pivot shaft is eccentrically and rotatably connected to the boot seat and the inner part of the control element. A distance between the pivot shaft and the second retaining notch is larger than a distance between the pivot shaft and the first retaining notch.

The adjusting unit includes a first adjusting element provided on a top of the engaging element, and a second adjusting element integrally formed at an underside of the toe cap corresponding to the first adjusting element. The second adjusting element includes a plurality of downward projected and longitudinally spaced teeth, which may be selectively engaged with the first adjusting element.

The control element is rotatable about the pivot shaft between a normal position and a push position when a force is applied to the outer part of the control element, such that the first adjusting element is brought by the control element in the normal and the push position to move to a lock and a release position, respectively, relative to the second adjusting element.

When the control element is in the normal position, the first adjusting element is in the lock position and the engaging element is aligned with and extended into the first retaining notch, and the first and the second adjusting element are engage with each other, preventing the toe cap from moving relative to the boot seat.

When the control element is turned away from the normal position in a predetermined direction, the engaging element is caused to detach from the first retaining notch to press against the curved peripheral surface, and finally align with and extend into the second retaining notch when the control element is turned to the push position. The control element in the push position pushes the engaging element to move in a direction opposite to the mounting recess, so that the first adjusting element is moved to the release position and does not interfere with the second adjusting element, allowing the toe cap to be moved longitudinally relative to the boot seat.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
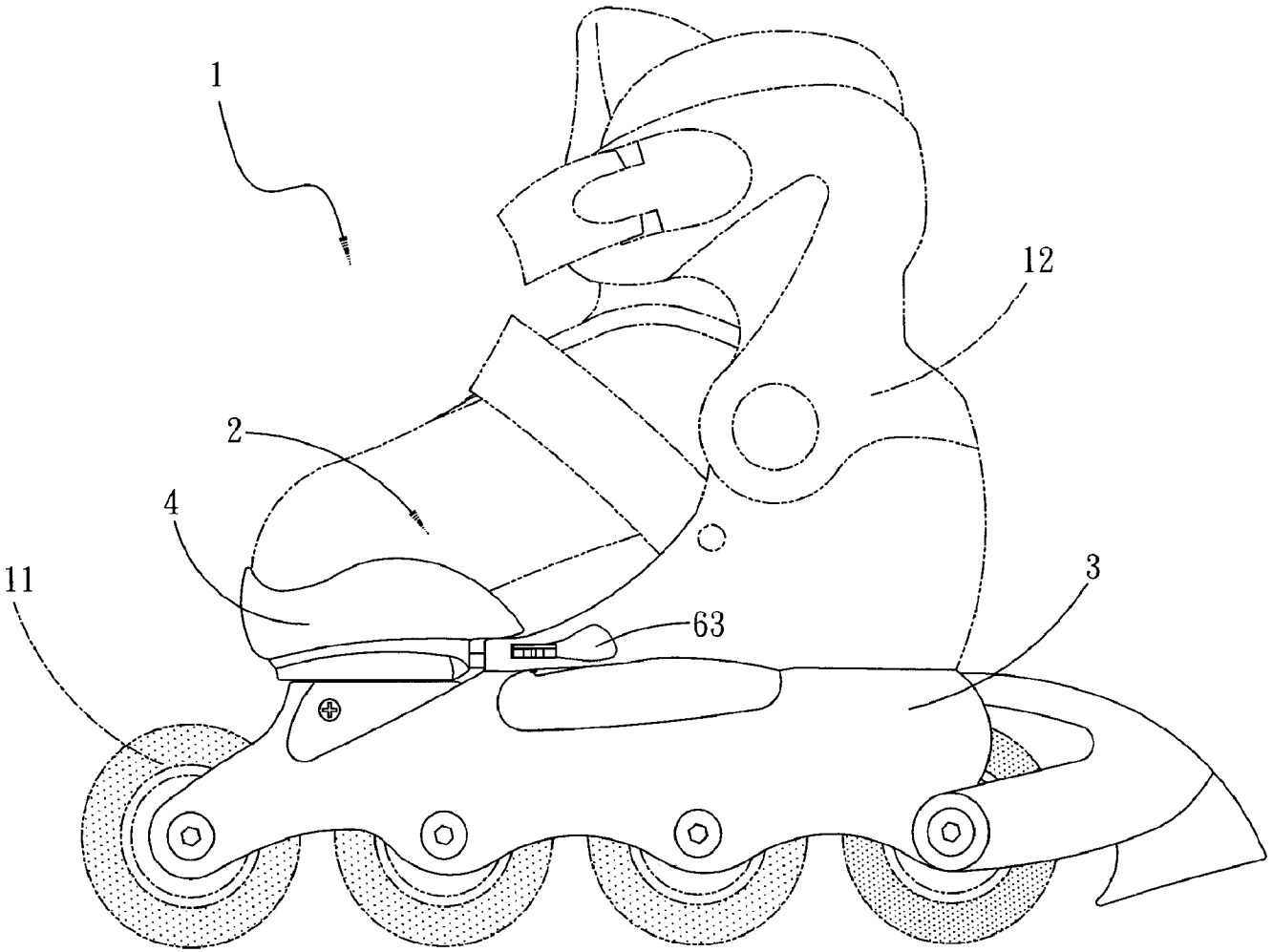
FIG. 1 is an assembled perspective view of an inline roller skate with a size adjusting mechanism according to a preferred embodiment of the present invention.
Figure 2:
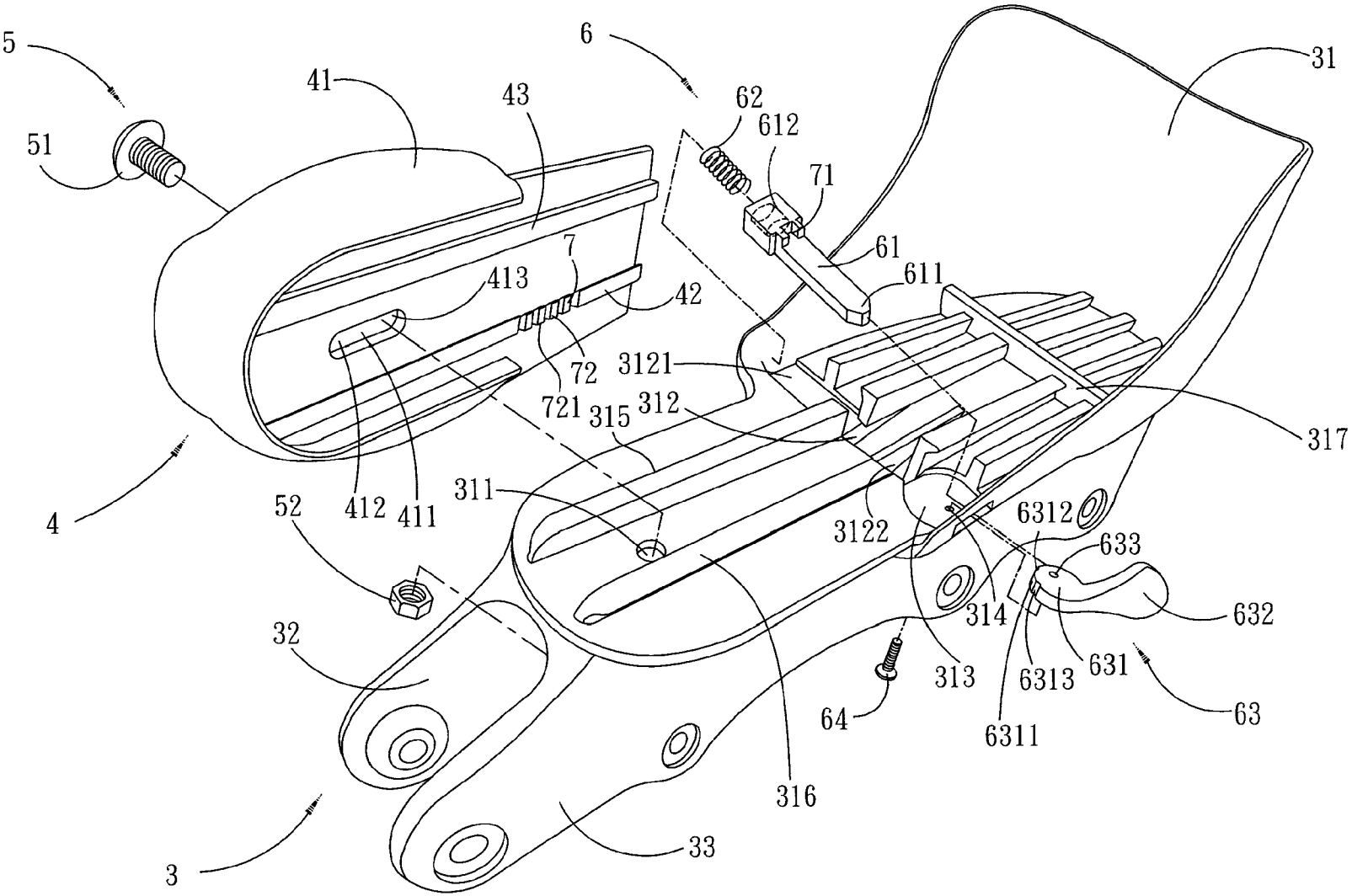
FIG. 2 is an exploded view of the size adjusting mechanism for the inline roller skate shown in FIG. 1.

Please refer to FIG. 1 that is an assembled perspective view of an inline roller skate 1 with a size adjusting mechanism 2 according to a preferred embodiment of the present invention, and to FIG. 2 that is an exploded perspective view of the size adjusting mechanism 2. As shown, the inline roller skate 1 also includes a plurality of wheels 11 rotatably mounted to and longitudinally spaced along a lower side of the size adjusting mechanism 2, and a boot 12 connected to a top of the size adjusting mechanism 2 for protecting a user's foot put in the boot 12.

The size adjusting mechanism 2 includes a boot seat 3, a toe cap 4, a limiting unit 5, a control unit 6, and an adjusting unit 7.

The boot seat 3 includes a seat main body 31; and a first and a second sidewall 32, 33 respectively downward projected from and longitudinally extended along a lower left and a lower right side of the seat main body 31, when viewing from a front side of FIG. 2. The wheels 11 are rotatably mounted to the boot seat 3 between the first and the second side wall 32, 33 to longitudinally space from one another.

The seat main body 31 of the boot seat 3 is provided near a front end with a vertically extended through hole 311, near an upper left middle area with a transversely extended slide way 312, near an upper right middle area with an inward extended mounting recess 313 communicating with a right side of the slide way 312, and in the mounting recess with a vertically extended shaft hole 314. Wherein, a left side of the slide way 312 is defined as a first end 3121, and a right side of the slide way 312 is defined as a second end 3122 opposite to the first end 3121.

The seat main body 31 of the boot seat 3 further includes a first outer rail 315 and a second outer rail 316, which are respectively longitudinally extended near and along an upper left and an upper right side of the seat main body 31 and spaced from each other; and a stopper 317 transversely extended across a top of the seat main body 31 near rear ends of the first and the second outer rail 315, 316. Each of the first and the second outer rail 315, 316 has an open front end, while the rear end is closed by the stopper 317.

Figure 3:
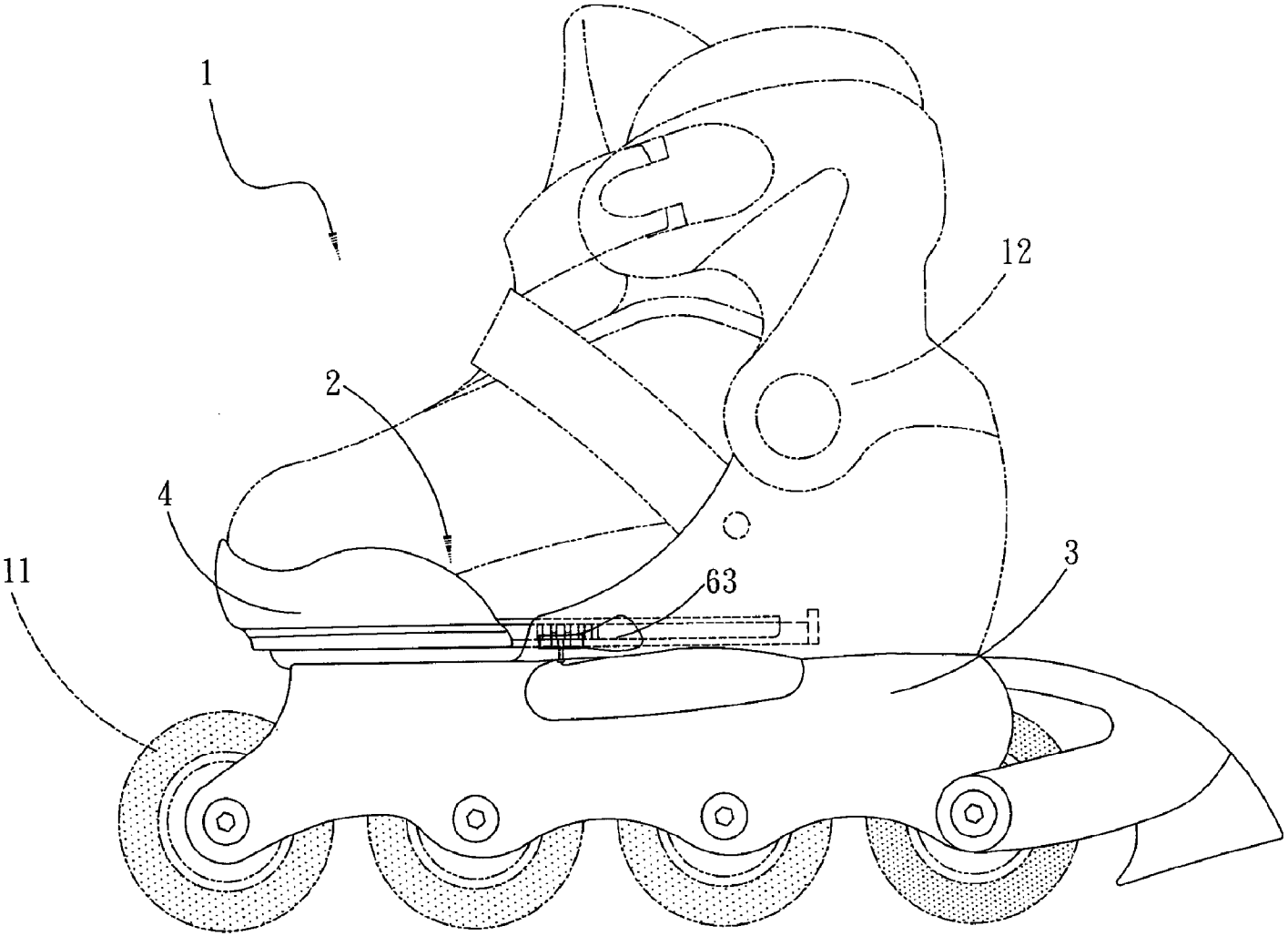
FIG. 3 shows the inline roller skate of FIG. 1 is adjusted to a larger size using the size adjusting mechanism thereof.

Please also refer to FIG. 3. The toe cap 4 is longitudinally movably assembled to a top of the boot seat 3. The toe cap 4 includes a toe cap main body 41 located above a front part of the seat main body 31, and a first and a second inner rail 42, 43 downward projected from and longitudinally extended through an underside of the toe cap main body 41 to space from each other and correspond to the first and the second outer rail 315, 316, respectively.

The toe cap main body 41 is provided with a longitudinally extended adjusting slot 411 corresponding to the through hole 311 on the seat main body 31. The adjusting slot 411 defines a front end 412 and a rear end 413 opposite to the front end 412.

The limiting unit 5 includes a limiting element 51 and a corresponding locking element 52 for fastening to the limiting element 51. The limiting element 51 is downward extended through the adjusting slot 411 on the toe cap 4 and the through hole 311 on the boot seat 3, such that a free end of the limiting element 51 is exposed to a space between the first and the second side wall 32, 33 for the locking element 52 to fasten thereto. With the limiting unit 5 vertically extended through the adjusting slot 411, the longitudinally movable toe cap 4 is limited to displace relative to the boot seat 3 only within a range defined between the front end 412 and the rear end 413 of the adjusting slot 411. In the illustrated preferred embodiment, the limiting element 51 is a screw, and the locking element 52 is a nut.

Figure 4:
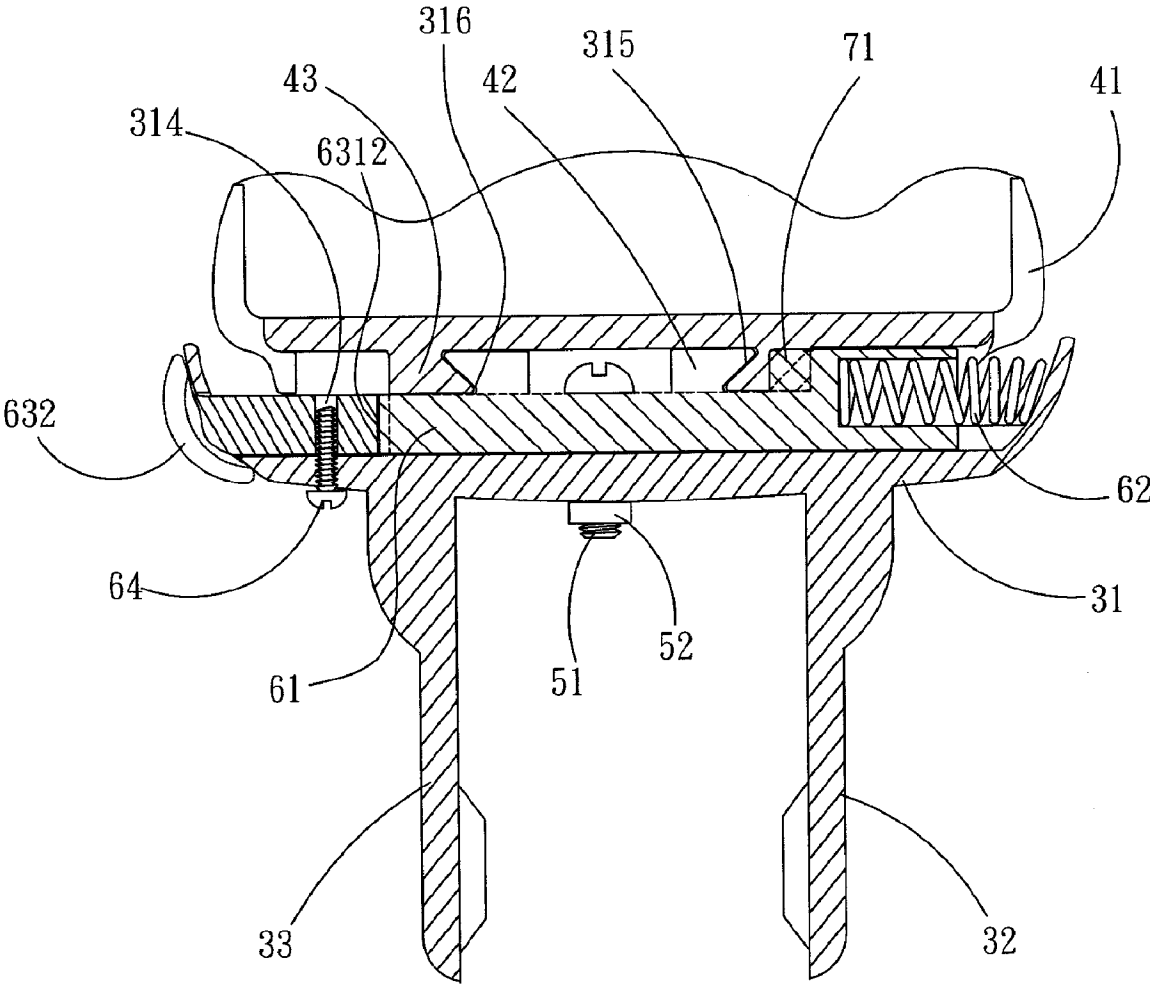
FIG. 4 is an assembled cross-sectional view showing an internal arrangement of the size adjusting mechanism for inline roller skate according to the present invention.
Figure 5:
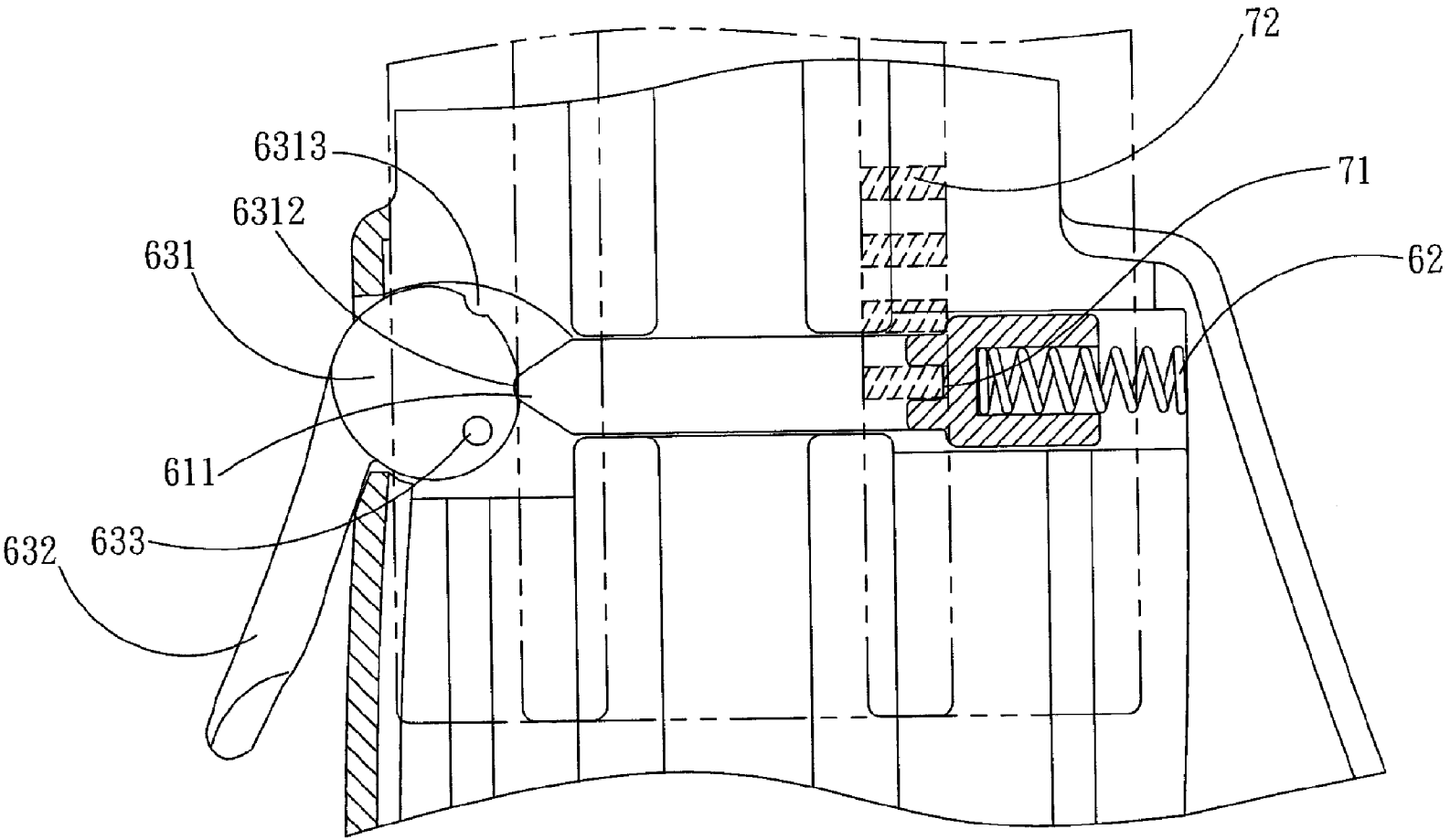
FIG. 5 is an assembled sectioned top view showing the arrangement of the size adjusting mechanism for inline roller skate according to the present invention.

Please also refer to FIGS. 4 and 5, which are sectioned rear and top views of the size adjusting mechanism 2.

The control unit 6 includes an engaging element 61, an elastic element 62, a control element 63, and a pivot shaft 64.

The engaging element 61 is positioned in the slide way 312 on the seat main body 31 to be transversely movable between the first end 3121 and the second end 3122 of the slide way 312. The engaging element 61 includes a right end formed into an engaging section 611 and a left end internally formed with a receiving space 612.

In the illustrated preferred embodiment, the elastic element 62 is a coil spring, a right end of which is received in the receiving space 612 on the engaging element 61, and a left end of which is pressed against a left inner wall surface of the seat main body 31, so as to constantly provide a rightward restoring force to push the engaging element 61 to the second end 3122 of the slide way 312, allowing the engaging element 61 to normally contact with a curved peripheral surface 6311 of the control element 63.

The control element 63 includes an retaining head 631, which forms an inner part of the control element 63 being sidewardly extended into the seat main body 31 to be mounted on the mounting recess 313 on the seat main body 31; a lever 632, which forms an outer part of the control element 63 being outward extended from a right side the retaining head 631 to expose to and be accessible from an outer side of the seat main body 31; and a threaded hole 633 extended through the retaining head 631 to correspond to the shaft hole 314 in the mounting recess 313. Wherein, the retaining head 631 has a left end surface formed into the above-mentioned curved peripheral surface 6311, on which a first retaining notch 6312 and a second retaining notch 6313 are formed and spaced from each other by a predetermined distance. The engaging element 61 is elastically pushed by the elastic element 62 to the second end 3122 of the slide way 312 to selectively extend the engaging section 611 into one of the first and the second retaining notch 6312, 6313. It is noted the threaded hole 633 is eccentric relative to the retaining head 631, and a distance between the threaded hole 633 and the second retaining notch 6313 is larger than a distance between the threaded hole 633 and the first retaining notch 6312. Moreover, the first retaining notch 6312 is closer to a rear end of the boot seat 3 than the second retaining notch 6313.

In the illustrated embodiment, the pivot shaft 64 is a screw, which is upward extended through the shaft hole 314 on the seat main body 31 to screw into the threaded hole 633 on the control element 63.

The adjusting unit 7 includes a first adjusting element 71 formed on a top of the engaging element 61 opposite to the engaging section 611, and a second adjusting element 72 integrally formed on the first inner rail 42 below the toe cap 4. In the illustrated preferred embodiment, the first adjusting element 71 is in the form of an open slot with an open end facing toward the engaging section 611, and the second adjusting element 72 is in the form of a rack having a plurality of lengthwise spaced teeth 721 for selectively and detachably engaging with the open slot of the first adjusting element 71, so that the toe cap 4 is held in place without moving relative to the boot seat 3.

When an external force is applied to the control element 63, it may be turned about the pivot shaft 64 relative to the engaging element 61 between a normal position, in which the first adjusting element 71 is caused to locate at a lock position relative to the second adjusting element 72, and a push position, in which the first adjusting element 71 is caused to locate at a release position relative to the second adjusting element 72.

As can be clearly seen from FIGS. 4 and 5, when the control element 63 is in the normal position, the first adjusting element 71 is in the lock position. At this point, the engaging section 611 of the engaging element 61 is aligned with and extended into the first retaining notch 6312 on the control element 63, and the engaging element 61 is located at the second end 3122 of the slide way 312 with one of the teeth 721 of the second adjusting element 72 received in the open slot of the first adjusting element 71, preventing the toe cap 4 from moving longitudinally relative to the boot seat 3.

Figure 6:
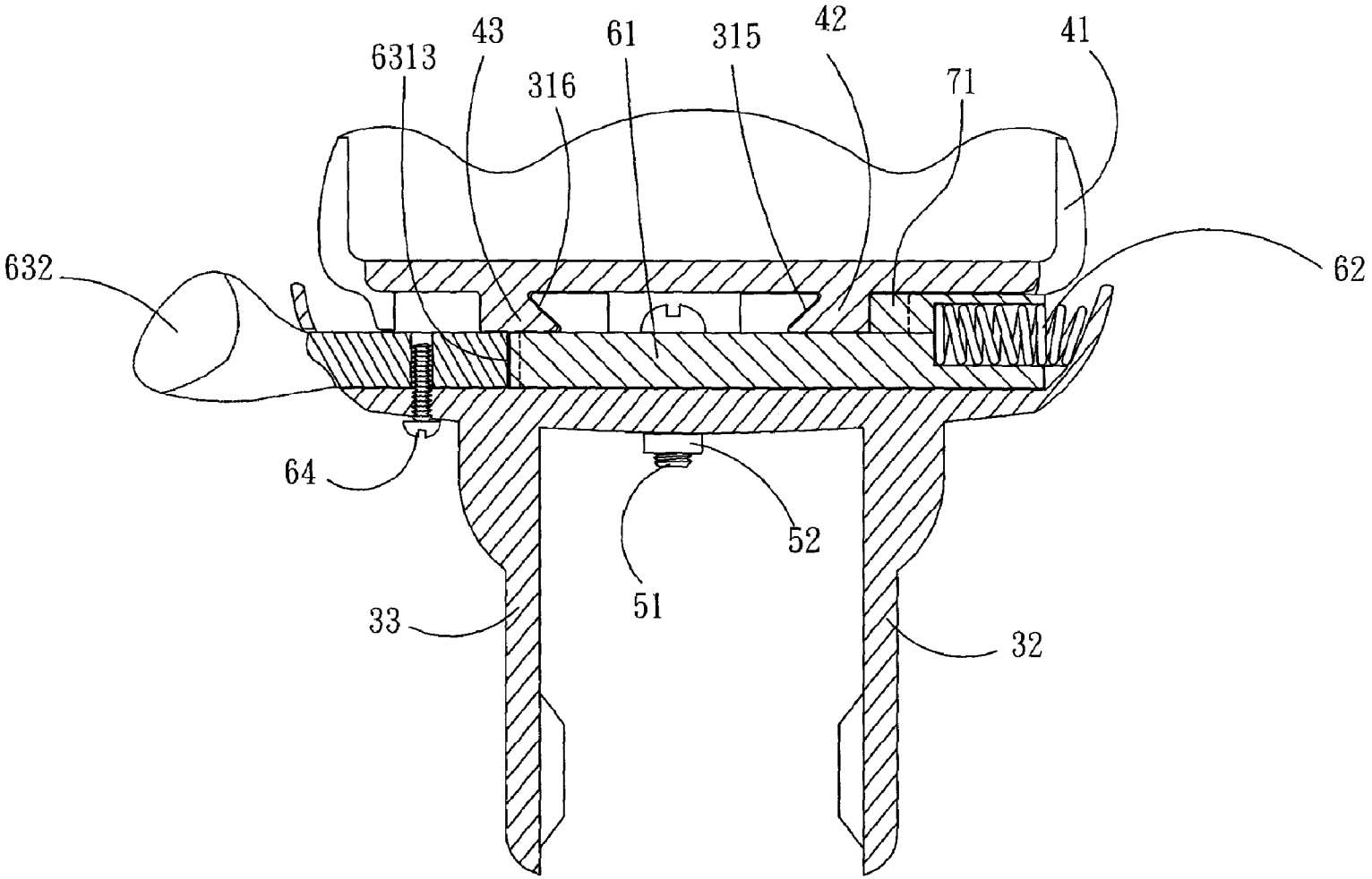
FIG. 6 is another assembled cross-sectional view showing the size adjusting mechanism for inline roller skate according to the present invention is in a position for adjusting the size of the inline roller skate.
Figure 7:
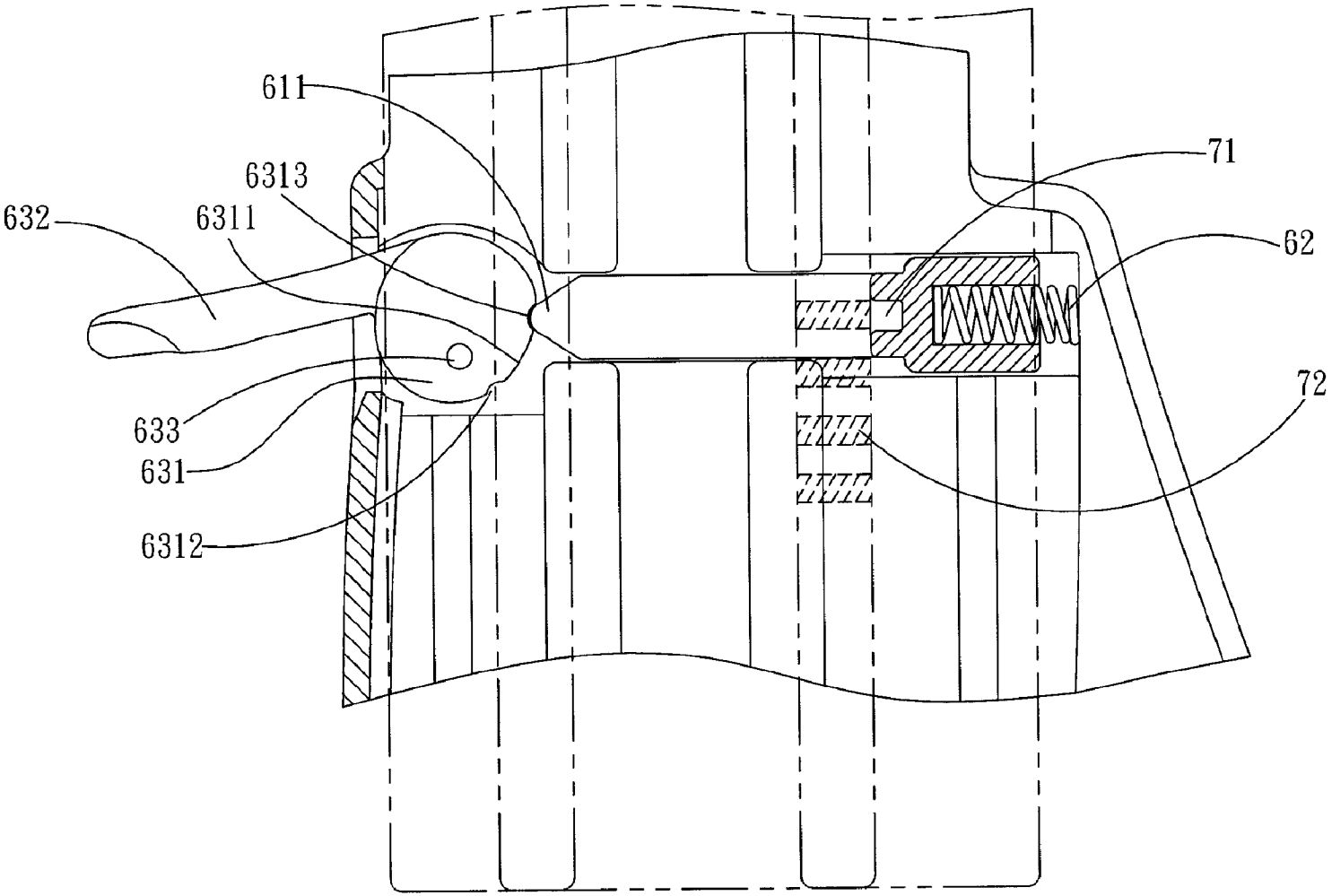
FIG. 7 is another assembled sectioned top view showing the size adjusting mechanism for inline roller skate according to the present invention is in a position for adjusting the size of the inline roller skate.

Please refer to FIGS. 6 and 7. When a clockwise force is applied to the lever 632 to turn the control element 63 and accordingly the retaining head 631, the first retaining notch 6312 on the retaining head 631 is forced to separate from the engaging section 611 of the engaging element 61, causing the engaging section 611 to press against the curved peripheral surface 6311 while the control element 63 is continuously turned. When the control element 63 is turned to finally align the second retaining notch 6313 with the engaging section 611, the engaging section 611 is pushed by the elastic element 62 into the second retaining notch 6313 and held thereto. Since the distance between the eccentric threaded hole 633 and the second retaining notch 6313 is larger than that between the threaded hole 633 and the first retaining notch 6312, the contact of the engaging section 611 with the curved peripheral surface 6311 would bring the engaging element 61 to move leftward and away from the second end 3122 of the slide way 312, causing the first adjusting element 71 to move backward and disengage from the second adjusting element 72. And, when the engaging section 611 is aligned with and extended into the second retaining notch 6313, the engaging element 61 is held to the first end 3121 of the slide way 312, and the first adjusting element 71 does not interfere with the second adjusting element 72. At this point, the control element 63 is in the push position, the first adjusting element 71 is in the release position, the elastic element 62 is compressed to store a restoring force, and the toe cap 4 can be longitudinally moved to align one of the teeth 721 of the second adjusting element 72 with the open slot of the first adjusting element 71, so as to adjust the inline roller skate 1 to a desired size. With the limiting element 51, the toe cap 4 can be longitudinally displaced only within a range defined between the front end 412 and the rear end 413 of the adjusting slot 411, preventing the toe cap 4 from completely separating from the boot seat 3.

When the toe cap 4 has been adjusted to a desired position relative to the boot seat 3, the control element 63 may be turned counterclockwise to disengage the second retaining notch 6313 from the engaging section 611 of the engaging element 61, allowing the curved peripheral surface 6311 to press against the engaging section 611 when the control element 63 is being turned. Meanwhile, the engaging element 61 is pushed rightward by the restoring force of the elastic element 62 toward the second end 3122 of the slide way 312 until the engaging section 611 is extended into the first retaining notch 6312 again. Meanwhile, the first adjusting element 71 on the engaging element 61 is synchronously moved rightward to engage with the selected tooth 721 of the second adjusting element 72. At this point, the control element 63 is in the normal position, the first adjusting element 71 is in the lock position, and the toe cap 4 is immovable relative to the boot seat 3.

It is understood the first adjusting element 71 and the second adjusting element 72 may be exchanged in their position without being limited to the position as illustrated in the preferred embodiment.

With the above arrangements, the adjusting unit 7 and the control unit 6 of the size adjusting mechanism 2 together enable a user to easily, conveniently, and quickly adjust the size of the inline roller skate 1 without the need of disassembling and reassembling any part of the inline roller skate 1. Therefore, the present invention is novel and provides high applicability.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A size adjusting mechanism for inline roller skate, the inline roller skate including a plurality of wheels mounted to a lower side of the size adjusting mechanism, and a boot connected to an upper side of the size adjusting mechanism for protecting a user's foot put therein; the size adjusting mechanism comprising:

a boot seat being provided with a mounting recess, which is inwardly extended from a lateral side of the boot seat;

a toe cap being longitudinally movably connected to a top front of the boot seat;

a control unit including:

an engaging element being transversely movably mounted in the boot seat at a predetermined position;

a control element having an inner part received in the mounting recess and an outer part exposed to an outer side of the boot seat; and the inner part of the control element received in the mounting recess having a curved peripheral surface, which is in contact with the engaging element and has a first and a second retaining notch spaced thereon; and a pivot shaft being eccentrically and rotatably connected to the boot seat and the inner part of the control element, such that a distance between the pivot shaft and the second retaining notch is larger than a distance between the pivot shaft and the first retaining notch; and an adjusting unit including a first adjusting element provided on a top of the engaging element, and a second adjusting element integrally formed at an underside of the toe cap corresponding to the first adjusting element; and the second adjusting element including a plurality of downward projected and longitudinally spaced teeth, which may be selectively engaged with the first adjusting element;

the control element being rotatable about the pivot shaft between a normal position and a push position when a force is applied to the outer part of the control element, such that the first adjusting element is brought by the control element in the normal and the push position to a lock and a release position, respectively, relative to the second adjusting element;

the control element in the normal position bringing the engaging element to align with and extend into the first retaining notch, and the first adjusting element to the lock position to engage with the second adjusting element, preventing the toe cap from longitudinally moving relative to the boot seat; and the control element being turned away from the normal position in a predetermined direction causing the engaging element to detach from the first retaining notch to press against the curved peripheral surface, and finally align and extend into the second retaining notch when the control element is turned to the push position; and the control element in the push position pushing the engaging element to move in a direction opposite to the mounting recess, so that the first adjusting element does not interfere with the second adjusting element, allowing the toe cap to be longitudinally moved relative to the boot seat.

2. The size adjusting mechanism for inline roller skate as claimed in claim 1, wherein the engaging element is provided at an end opposite to the control element with a receiving space, and wherein the control element further includes an elastic element; the elastic element being received in the receiving space on the engaging element with an outer end pressed against an inner wall surface of the boot seat, so as to constantly provide a restoring force against the engaging element for the same to always contact with the curved peripheral surface of the inner part of the control element.

3. The size adjusting mechanism for inline roller skate as claimed in claim 1, wherein the boot seat includes a seat main body, and a first and a second side walls separately downward projected from and longitudinally extended along two lower lateral sides of the seat main body to space from each other, and the wheels of the inline roller skate being rotatably mounted to the boot seat between the first and the second side wall.

4. The size adjusting mechanism for inline roller skate as claimed in claim 2, wherein the boot seat includes a seat main body, and a first and a second side walls separately downward projected from and longitudinally extended along two lower lateral sides of the seat main body to space from each other, and the wheels of the inline roller skate being rotatably mounted to the boot seat between the first and the second side wall.

5. The size adjusting mechanism for inline roller skate as claimed in claim 1, further comprising a limiting unit that includes a limiting element and a locking element fastened to the limiting element; and wherein the boot seat is provided at a predetermined position with a vertically extended through hole, and the toe cap is provided at a predetermined position with a longitudinally extended adjusting slot, which is corresponding to the through hole on the boot seat and defines a front end and a rear end opposite to the front end; and the limiting element being downward extended through the adjusting slot and the through hole to fasten to the locking element.

6. The size adjusting mechanism for inline roller skate as claimed in claim 2, further comprising a limiting unit that includes a limiting element and a locking element fastened to the limiting element; and wherein the boot seat is provided at a predetermined position with a vertically extended through hole, and the toe cap is provided at a predetermined position with a longitudinally extended adjusting slot, which is corresponding to the through hole on the boot seat and defines a front end and a rear end opposite to the front end; and the limiting element being downward extended through the adjusting slot and the through hole to fasten to the locking element.

7. The size adjusting mechanism for inline roller skate as claimed in claim 1, wherein the boot seat is provided at the upper side with a transverse slide way having a first end and a second end opposite to the first end; and the engaging element being slidably positioned in the slide way to move between the first and the second end.

8. The size adjusting mechanism for inline roller skate as claimed in claim 2, wherein the boot seat is provided at the upper side with a transverse slide way having a first end and a second end opposite to the first end; and the engaging element being slidably positioned in the slide way to move between the first and the second end.

9. The size adjusting mechanism for inline roller skate as claimed in claim 1, wherein the boot seat is provided at the upper side with a first and a second longitudinally extended outer rail that are laterally spaced from each other by a predetermined distance; and the toe cap is provided at the underside with a first and a second longitudinally extended inner rail that are laterally spaced from each other to correspond to the first and the second outer rail, respectively; and the second adjusting element being integrally formed at a bottom of the first inner rail.

10. The size adjusting mechanism for inline roller skate as claimed in claim 2, wherein the boot seat is provided at the upper side with a first and a second longitudinally extended outer rail that are laterally spaced from each other by a predetermined distance; and the toe cap is provided at the underside with a first and a second longitudinally extended inner rail that are laterally spaced from each other to correspond to the first and the second outer rail, respectively; and the second adjusting element being integrally formed at a bottom of the first inner rail.

11. The size adjusting mechanism for inline roller skate as claimed in claim 9, wherein the boot seat includes a stopper transversely located near rear ends of the first and the second outer rail.

12. The size adjusting mechanism for inline roller skate as claimed in claim 10, wherein the boot seat includes a stopper transversely located near rear ends of the first and the second outer rail.

* * * * *